United States Patent [19]

Popplewell et al.

[11] 4,005,003

[45] Jan. 25, 1977

[54] MULTI-COMPONENT METAL ELECTRODE

[75] Inventors: James M. Popplewell, Guilford; Michael J. Pryor, Woodbridge; Alexander F. Beck, Hamden, all of Conn.

[73] Assignee: Olin Corporation, New Haven, Conn.

[22] Filed: Apr. 15, 1975

[21] Appl. No.: 568,353

[52] U.S. Cl. ..... 204/290 F

[51] Int. Cl.[2] ..... C25B 11/10

[58] Field of Search ..... 204/290 F

[56] References Cited

UNITED STATES PATENTS

| | | | |
|---|---|---|---|
| 3,234,110 | 2/1966 | Beer | 204/290 F X |
| 3,562,008 | 2/1971 | Martinsons | 427/126 |
| 3,632,498 | 1/1972 | Beer | 204/290 F |
| 3,657,102 | 4/1972 | Keith et al. | 204/290 F |
| 3,663,280 | 5/1972 | Lee | 427/126 |
| 3,671,415 | 6/1972 | King et al. | 204/284 |
| 3,718,551 | 2/1973 | Martinsons | 204/98 |
| 3,773,555 | 11/1973 | Cotton et al. | 427/123 |

*Primary Examiner*—F.C. Edmundson

*Attorney, Agent, or Firm*—Donald F. Clements; James B. Haglind; Thomas P. O'Day

[57] ABSTRACT

A multi-component metal electrode and a method for its preparation is described in which a film-forming metal base such as titanium is coated with an oxide of a film-forming metal, and then further coated with a conductive oxide, such as ruthenium oxide. A corrosion resistant oxide such as tantalum oxide, is applied to the ruthenium oxide.

The corrosion-resistant metal oxide is formed by applying to the ruthenium oxide a solution of an inorganic compound of the corrosion-resistant metal, and heating the solution-coated electrode to evaporate the solvent and form a corrosion-resistant metal oxide.

The resulting multi-component metal electrode of this invention can be used as an electrode in mercury cells and diaphragm cells.

10 Claims, 3 Drawing Figures

MULTI-COMPONENT METAL ELECTRODE

This invention relates to an improved multi-component metal electrode.

Electrolytic cells, such as mercury cathode cells and diaphragm cells, are used extensively to electrolytically decompose inorganic salts such as aqueous sodium chloride solutions to form chlorine and caustic. Recently, conventional graphite electrodes have been replaced in these cells with metal electrodes of a variety of compositions. Metal anodes have proved to be advantageous, particularly in mercury cells, because of the improved stability over carbon anodes, which permits closer control of the gap between the anode and cathode, thereby resulting in lower voltage and higher current density.

Generally, metal electrodes are comprised of a base of a film-forming metal coated with a conductive metal or an oxide thereof, which is frequently a metal of the platinum group. One of the problems with certain metal electrodes is that the conductive metal or oxide thereof is gradually dissolved when contacted with a corrosive electrolyte during electrolysis. For example, ruthenium oxide present in the exterior coating of an electrode may be dissolved when subjected to extended contact with a corrosive brine such as an acidic sodium chloride brine and as a result, the conductive coating deteriorates and cell efficiency is markedly reduced.

One electrode design utilizes a film-forming metal base such as titanium which is coated with a mixture of a film-forming metal oxide and another metal oxide, such as ruthenium oxide.

Another electrode design is comprised of an electrically conductive base such as titanium which is coated with a mixed crystal comprised of at least one oxide of a film-forming metal and at least one oxide of a platinum group metal.

In another method for preparing electrodes, an organic compound of a film-forming metal is applied to a metal anode comprised of a film-forming metal base coated with a platinum metal or platinum metal oxide. This method is concerned primarily with applying organic titanate coatings to platinum metal oxides and then heating to form a titanium oxide exterior.

Although such coated anodes may be effective replacements for graphite electrodes in electrolytic cells, there is a need to improve the stability and performance of metal electrodes.

It is a primary object of this invention to provide a metal electrode for electrolytic cells having improved chemical stability when contacted with corrosive electrolytes.

It is another object of this invention to provide a method for improving the chemical stability of metal electrodes.

It is a further object of this invention to provide a novel conductive metal anode coating in which the conductive metal or oxide thereof is inhibited against dissolution when contacted with a corrosive electrolyte in an electrolytic cell.

Still another object of the invention is to provide a multi-component electrode having improved chemical stability when in contact with corrosive electrolytes.

These and other objects of the invention will be apparent from the following detailed description thereof.

It has now been discovered that the foregoing objects are accomplished in a multi-component electrode having a conductive metal oxide component such as ruthenium oxide together with a chemically resistant metal oxide. In a preferred embodiment, the multi-component electrode is comprised of:

a. a film-forming metal base coated with b. a porous oxide of a film-forming metal, c. a conductive oxide such as ruthenium oxide covering and penetrating the porous oxide coating together with d. a chemically resistant metal oxide such as tantalum oxide.

In the novel method of this invention, the corrosion resistant metal oxide is formed by applying to at least a portion of the total coating, an inorganic compound capable of forming the corrosion resistant metal oxide. The inorganic compound, preferably a halide, is heated under appropriate temperature and time conditions to effect the formation of a dispersion of the corrosion resistant metal oxide with the ruthenium oxide component. The resulting multi-component metal electrode is extremely stable under electrolysis conditions in electrolytic cells employing corrosive brines as the electrolyte, since the corrosion resistant metal oxide prevents dissolution of the ruthenium oxide component. This improves the operating costs and efficiency of the electrode in electrolytic cell operation.

Each of the micrographs have a magnification of 1400.

Figure 1:
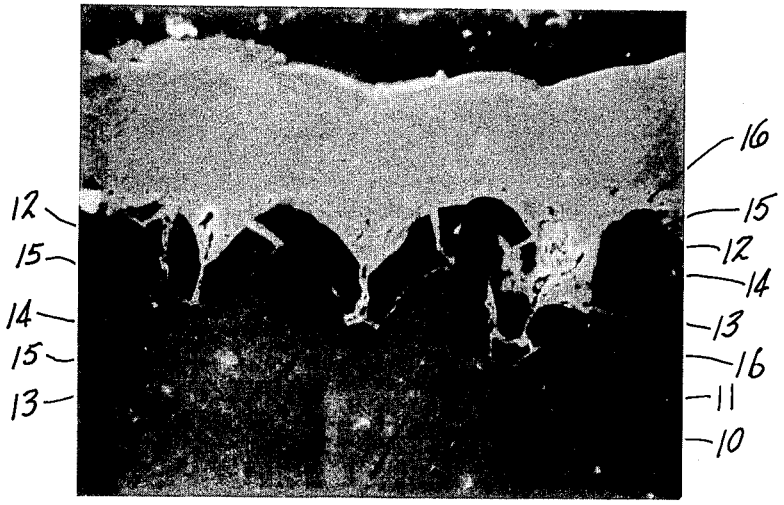
FIG. 1 is a scanning electron micrograph of a cross section of part of a novel multi-component metal anode rod of this invention prior to use as a component of an anode in a mercury cell.

Referring to the drawings in more detail, FIG. 1 is a scanning electron micrograph of a cross sectional view of part of rod 10 used to form an anode for a mercury cell (not shown). Rod 10 is comprised of an electrode base metal 11, such as titanium and a porous film-forming metal oxide coating 12, such as titanium oxide. After formation of the film-forming metal oxide coating 12, subsequent processing causes the formation of radial cracks 13 and partial detachment at the interface 14 between electrode base metal 11 and film-forming metal oxide 12. A conductive metal oxide 15, such as ruthenium oxide, penetrates the pores, radial cracks 13 and detached interface 14. The conductive metal oxide 15 bonds the film-forming metal oxide 12 to electrode base metal 11. It also coats the film-forming metal oxide 12. A chemically resistant oxide coating 16, tantalum oxide is applied to conductive metal oxide 15 in such a manner as to penetrate to the precoat-metal interface 14.

Figure 2:
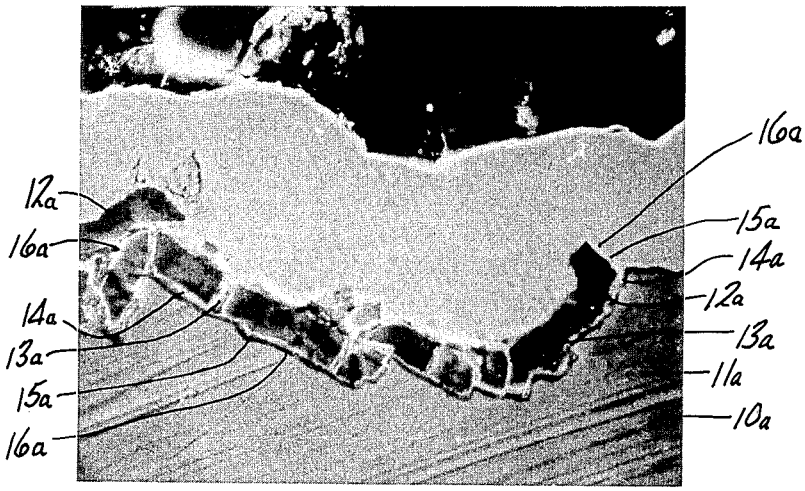
FIG. 2 is a similar view of a novel multi-component metal anode rod of this invention after three months service in a mercury cell.

FIG. 2 shows a similar view of a rod **10*a* after service as part of an anode in a mercury cell for three months. The conductive metal oxide 15*a*, ruthenium oxide, positioned in radial cracks 13*a* and detached interfaces 14*a* has been protected by chemically resistant oxide 16*a*, tantalum oxide, from dissolution by the corrosive electrolyte. The film-forming metal oxide 12*a*, titanium oxide, is firmly secured to electrode base metal 11*a***, titanium, and the anode operated without any significant change in voltage after the three month period.

Figure 3:
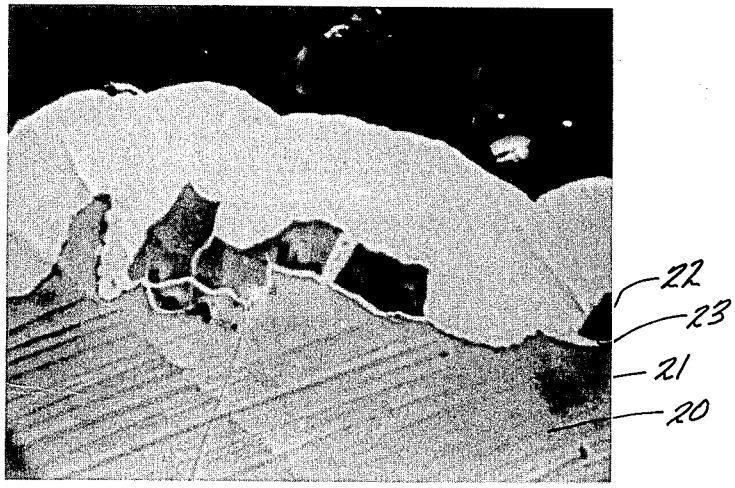
FIG. 3 is a similar view of another metal rod without tantalum oxide after three months service in a mercury cell.

FIG. 3 is a scanning electron micrograph of a cross section of a part of rod 20 after three months service as part of an anode in a mercury cell. Rod 20 was not prepared in accordance with this invention, but instead was comprised of an electrode base metal 21, titanium, a film-forming metal oxide 22, titanium oxide, and a conductive metal oxide 23, ruthenium oxide. The micrograph shows that a substantial amount of ruthenium oxide 23 has been dissolved, resulting in detachment and loss of the ruthenium oxide impregnated titanium oxide conductive layer 22. This caused a marked increase in voltage required to operate this anode and a short operating life.

More in detail, the chemically resistant oxide coating 15 of this invention can be applied to any electrode having an active conductive oxide 12 such as ruthenium oxide as a component. However, it is particularly suited for application to a multi-component electrode comprised of a film-forming metal as the electrode base metal 11 having an electrodeposited porous film-forming metal oxide coating 12 which is further coated and impregnated with a conductive metal oxide 15 including ruthenium oxide.

In mercury cells, the anode is generally in the form of parallel, spaced apart metal rods, expanded metal, screen or other porous forms. In diaphragm cells, the anode or cathode may be a metal plate, or porous forms of the type previously described for mercury cell anodes. Generally, the electrode base metal 11 is a film-forming metal such as titanium, zirconium, niobium, tantalum, tungsten, or an alloy predominating in one of these metals, and having anodic polarization properties in the electrolyte where the electrode is to be used which are comparable to those of the pure metal. Titanium or tantalum is preferably employed as the base material, but alloys of titanium or tantalum with other film-forming metals may also be employed.

In order to prepare the novel multi-component electrode of this invention, the film-forming metal base or alloy is first etched to roughen the surface by submerging it in a weak acid solution such as a dilute solution of oxalic acid. The electrode base metal 11 is then coated with a film-forming metal oxide 12 by employing the etched electrode base metal 11 as an anode in an electrolytic cell containing a solution of a salt of the film-forming material, which upon electrolysis forms a thin porous precoat of the oxide of the film-forming metal 12 on the surface of electrode base metal 11. Suitable salts of the film-forming metal include sulfates, chlorides, nitrates, and the like.

After removal of the film-forming metal oxide coated anode from the electrolyte, it is washed with water to remove electrolyte and preferably dried before further coating.

A coating of a conductive oxide forming material 13 is then formed on the porous film-forming metal oxide 12 by coating the electrode with a solution of a ruthenium compound, which upon firing is capable of forming ruthenium oxide. U.S. Pat. No. 3,711,385, which issued Jan. 16, 1973, describes a procedure for forming ruthenium oxide on the surface of the film-forming metal base. U.S. Pat. No. 3,645,862, which issued Feb. 2, 1972, also describes a technique for forming ruthenium oxide on the surface of a film-forming metal electrode, such as titanium. If desired, pre-formed oxides of ruthenium oxide may also be applied in molten form or as a colloidal solution of the oxide.

Generally the procedure for forming the conductive oxide comprises preparing a solution of a ruthenium compound such as ruthenium chloride in a suitable solvent, applying the solution to the electrode, and firing to effect evaporation of the solvent and conversion of the ruthenium compound to ruthenium oxide.

Heating the coated anode to convert the ruthenium oxide-forming compound to conductive ruthenium oxide causes substantial rupturing of the bond between film-forming metal oxide 12 and electrode base metal 11. As a result, the ruthenium oxide-forming compound eventually penetrates the voids and forms an interfacial layer between the electrode base metal 11 and the precoat of film-forming metal oxide 12. This interfacial ruthenium oxide layer acts as an effective glue resulting in a strong bond between the titanium and titanium oxide. Heating also causes radial cracks to form in film-forming metal oxide 12 which are also filled with ruthenium oxide in the same manner.

Application of a plurality of layers of ruthenium oxide on the film-forming metal oxide 13 may be repeated as frequently as desired until the loading of the ruthenium oxide has reached the desired level. Generally, the ruthenium oxide component comprises at least about 20 percent by weight of the total weight of film-forming metal oxide 12 and conductive metal oxide 15.

Applying ruthenium oxide in this manner not only improves the electrical properties of the resulting electrode but also serves to provide an intermediate adhesive layer in the interface between the electrode base metal 11 and the film-forming metal oxide 12.

In order to prevent leaching of the ruthenium oxide 15 at the precoat-metal interface 14 and in radial cracks 13, and ultimate spalling of the ruthenium oxide impregnated film-forming metal oxide 12, a chemically resistant metal oxide 16, such as tantalum oxide, is applied in such a manner as to penetrate to the precoat-metal interface 14. Tantalum oxide is formed by applying an inorganic tantalum compound which is capable of forming tantalum oxide when fired under appropriate conditions. It is preferred to employ a halide of tantalum, such as tantalum pentachloride, tantalum pentafluoride, and tantalum pentabromide. However, tantalum pentachloride is most preferably employed. The tantalum compound is applied as a solution in any convenient solvent, or as a colloidal solution or slurry of finely divided particles, i.e., below about 200 mesh, of the tantalum compound.

The solution of inorganic tantalum compound is applied by painting, spraying, dipping, or any other convenient manner of applying the oxide-forming tantalum compound to the multi-component metal electrode. After the solution is applied to the electrode in this manner, it is heated at a temperature in the range from about 400° to about 600° C., and preferably from about 450° to about 550° C. The coated electrode is maintained under these temperature conditions for a period of time ranging from about 5 to about 120, and preferably from about 15 to about 30 minutes, in order to evaporate the solvent and effect conversion of the tantalum compound to the tantalum oxide, preferably tantalum pentoxide which is extremely resistant to dissolution by the corrosive electrolyte. A plurality of applications of the inorganic tantalum compound may be made until the desired loading level of tantalum oxide is obtained. Generally, the total tantalum oxide loading ranges from about 0.1 to about 5 and preferably from about 1 to about 3 grams per square meter of electrode surface. The interfacial layer 14 between the precoat and metal, and radial cracks 13 becomes a mixture of ruthenium oxide and tantalum oxide. The level of tantalum oxide should constitute from about 5 to about 30 percent and preferably from about 10 to 20 percent by weight of the mixture.

Suitable solvents for the tantalum compound or other compound capable of forming a chemically resistant oxide include aqueous solutions of inorganic acids, such as hydrochloric acid or sulfuric acid, or organic compounds such as ethanol or ether. However, any inert solvent which is evaporated during the firing step may be employed as the solvent.

As indicated above, an oxide of tantalum, such as $Ta_2O_5$, is preferably employed as the chemically resistant oxide 16. Other chemically resistant oxides of other film-forming metals such as niobium oxide, zirconium oxide, molybdenum oxide, tungsten oxide, rhenium oxide, rhodium oxide, osmium oxide, hafnium oxide, and mixtures thereof may be employed by firing compounds of these film-forming metals capable of forming oxides. Modifications in the firing temperatures and the firing times may be necessary with the other compounds, depending upon the concentration and type of film-forming metal compounds initially employed.

The invention is not limited to applying each coating of ruthenium oxide first, followed by each coating of tantalum oxide. It is within the scope of this invention to apply a chemically resistant oxide coating 16 at any time in the sequence of applying a plurality of coatings of ruthenium oxide. Thus, alternate coatings of ruthenium oxide and tantalum oxide may be applied sequentially until the desired loading levels of ruthenium oxide and tantalum oxide have been achieved.

Metal anodes coated with the mixture of ruthenium oxide and a chemically resistant oxide coating 16, such as tantalum oxide, in accordance with this invention, resist dissolving by corrosive electrolytes such as salt brine, and have a markedly improved service life as compared to metal anodes which employ only a ruthenium oxide as the conductive metal oxide 15.

When a ruthenium oxide coated electrode, without application of tantalum oxide in accordance with this invention, is contacted with a corrosive electrolyte there is a reaction between the electrolyte and ruthenium oxide. As a result, the ruthenium oxide is dissolved, which weakens the bond between the titanium base and the ruthenium oxide impregnated titanium oxide. Undermining and spalling of the conductive layer is then effected, and as a result, there is a serious reduction in the effectiveness of the electrode. In contrast, when tantalum oxide is applied to the electrode in accordance with this invention, there is a marked reduction in the reaction between ruthenium oxide and the electrolyte, thereby extending the service life of the electrode.

Having thus described the invention, the following example is presented to define the invention more fully without any intention of being limited thereby.

EXAMPLE

Twenty metal anodes were constructed for use in a mercury amalgam electrolytic cell for the production of chlorine. Dimensions of the electrolytic cell were about 42 feet long, 4.5 feet wide and 1 foot high. Each of the metal anodes were comprised of two anode posts secured to a distributor, with a bandolier-type anodic surface secured to the distributor.

Each anode post was comprised of an upper rod made of copper having a diameter of about 1¼ inches and a height of about 4⅝ inches. This copper rod was friction welded to an aluminum rod having a diameter of 1¾ inches. The bottom of the aluminum rod was friction welded to the top of a distributor plate. Surrounding the aluminum-copper post was a titanium sleeve which was also friction welded at one end to the top of the distributor. The titanium sleeve had a height of about 10.35 inches and an outside diameter of about 2 inches.

The distributor was an inverted channel having a web with an inside width between legs of about 7⅜ inches. Legs extending downwardly from each side of the web were substantially parallel and had a height of about 1 inch. Extending outwardly from the end of each leg, and parallel to the web was a flange of about ½ inch in width.

The bottom of each flange on each set of channel legs was machined to be coplanar with each other for the length of each flange bottom.

The anodic surface was secured as a bandolier to the flange bottoms. Each bandolier was comprised of a series of parallel, spaced-apart rods which were secured on one end by welding to one of two bandolier strips which were spaced parallel to each other at the ends on the rods. Each rod had a titanium core and was coated as described below. Each rod had a length of about 9⅛ inches and a diameter of about 0.118 inch. Approximately 260 rods were spaced equidistant from each other along the length of the bandolier strips, which were approximately 4 feet long. Each bandolier strip was constructed of titanium and had a width of about 0.35 inch and a height of about 0.15 inch. The bandolier-type anode was secured to the distributor by filet welding the top of each bandolier strip to the bottom of one of the flanges secured to the channel legs.

Each metal anode had a surface area of 48 by 9 5/16 inches with an overall height of about 16⅜ inches. The height of the distributor and bandolier combined was approximately 1¼ inches. The anode posts were positioned in the center of the top of the distributor, the centers of the post being approximately 12 inches from each end of the distributor.

The bandolier comprised of two bandolier strips having the 260 titanium rods welded perpendicular thereto were each etched by submerging the bandoliers in an aqueous oxalic acid solution containing about 10 percent by weight of oxalic acid at a temperature of about 80° C. for about 16 hours. Following the oxalic acid immersion, the bandoliers were suspended in boiling water for about 1 hour. Each bandolier was removed from the boiling water bath and placed in an electrolytic cell having an electrolyte comprised of an aqueous titanium sulfate solution containing about 5 grams per liter of titanium sulfate. A direct current was passed across the cell at a voltage of about 12 volts for about 8 hours to form a porous coating of titanium oxide on the surface of the titanium rods and bandolier strips. The loading of the titanium oxide was about 20 grams per square meter. The resulting pre-coated bandoliers were then dried at about 50° C.

A ruthenium oxide coating was then formed on the bandoliers by applying three single coats of a solution of ruthenium trichloride in butanol presaturated with ammonium chloride, where the solution contained about 68 grams per liter of ruthenium. After each coat of ruthenium trichloride, the bandolier was fired at 500° C. for twenty minutes to convert the ruthenium chloride to ruthenium oxide.

After ten applications of ruthenium oxide in this manner, the anodes had a loading of about 12 grams per square meter of ruthenium as ruthenium oxide. The porous titanium oxide had also become completely saturated with ruthenium oxide.

The metal anodes were then painted with an acidified solution of tantalum pentachloride. After applying two coats of the tantalum pentachloride in this manner, the coated bandoliers were fired at 500° C. for about twenty minutes to convert the tantalum pentachloride to tantalum oxide. The loading of tantalum oxide was approximately 1 gram per square meter. The interfacial layer between the precoat and metal and in the radial cracks contained about 10 percent tantalum oxide, the remainder being essentially ruthenium oxide.

For purposes of comparison, thirty bandoliers were prepared in a similar manner except no tantalum oxide coating was applied. The bandoliers were then applied to the distributors and inserted into a commercial electrolytic mercury cell for the preparation of chlorine and caustic from salt brine, along with the above described 20 anodes coated with tantalum oxide in accordance with this invention.

Ten sets of anodes, each set containing five metal anodes parallel to each other, were placed in a mercury cell. The twenty anodes containing tantalum oxide were distributed throughout the length of the cell. Apparatus for adjusting the gap between anode and cathode as described in U.S. Pat. No. 3,574,073, issued Apr. 6, 1971, to R. W. Ralston, Jr., was used to operate the anodes.

Operation of the cell began by flowing mercury and salt brine through the cell, utilizing conventional cell operation and recovery techniques for chlorine, amalgam and brine regeneration.

The cell was operated at about 4.3 volts, with a voltage coefficient of about 0.12. After 3 months of operation, a sample of the anodes which did not contain tantalum oxide was examined by a scanning electron microscope. The results indicated that some of the ruthenium oxide had been dissolved, causing detachment and loss of the ruthenium oxide impregnated titanium oxide coating. It was necessary to replace these anodes after 177 days of operation.

In contrast, a sample of the anodes which contained tantalum oxide in accordance with this invention, was also examined after three months of operation. A scanning electron microscopic analyses showed that there was substantially no detachment of the ruthenium oxide impregnated titanium oxide. The anodes prepared in accordance with this invention operated for 252 days before replacement appeared to be warranted.

What is to be claimed by Letters Patent is:

1. A multi-component metal electrode comprised of
a. a film-forming metal base having
b. a coating comprised of
1. a porous oxide of a film-forming metal containing radial cracks and being partially detached from said film-forming metal base,
2. a ruthenium oxide-containing conductive oxide, and
3. a chemically resistant metal oxide derived from an inorganic compound comprising at least part of said conductive oxide.

2. The multi-component metal electrode of claim 1 wherein said chemically resistant metal oxide is selected from the group consisting of tantalum oxide, niobium oxide, zirconium oxide, molybdenum oxide, tungsten oxide, rhenium oxide, rhodium oxide, osmium oxide, hafnium oxide and mixtures thereof.

3. The multi-component metal electrode of claim 2 wherein voids are formed during processing by partial detachment at the interface between said metal base and said porous oxide, and voids are formed by radial cracks in said porous oxide, said voids contain a mixture of said ruthenium oxide-containing conductive oxide and said chemically resistant metal oxide, wherein said mixture contains from about 5 to about 30 percent by weight of said chemically resistant metal oxide, and the loading of said chemically resistant metal oxide on said metal electrode ranges from about 0.15 to about 5 grams per square meter of surface of said metal electrode.

4. The multi-component metal electrode of claim 3 wherein said film-forming metal is selected from the group consisting of titanium and tantalum.

5. The multi-component metal electrode of claim 4 wherein said electrode base metal has an etched surface.

6. The multi-component metal electrode of claim 5 wherein said etched surface is coated with said porous oxide of a film-forming metal, and said partial detachment is at the interface between said etched surface and said porous oxide.

7. The multi-component metal electrode of claim 6 wherein said mixture contains from about 10 to about 20 percent by weight of said chemically resistant metal oxide.

8. The multi-component metal electrode of claim 6 wherein said chemically resistant metal oxide is tantalum oxide.

9. The multi-component metal electrode of claim 8 wherein said electrode base metal is titanium and said porous oxide of a film-forming metal is titanium oxide.

10. The multi-component metal electrode of claim 9 wherein the proportion of said tantalum oxide is from about 1 to about 3 grams per square meter of surface of said metal electrode.

* * * * *